US006430953B2

(12) United States Patent
Roh

(10) Patent No.: US 6,430,953 B2
(45) Date of Patent: Aug. 13, 2002

(54) AIR CONDITIONER FOR MULTIPLE ROOM

(75) Inventor: Young Hoon Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/725,485

(22) Filed: Nov. 30, 2000

(30) Foreign Application Priority Data

Dec. 15, 1999 (KR) ..... 99/58018

(51) Int. Cl.[7] ..... F25B 49/02
(52) U.S. Cl. ..... 62/231; 62/175; 236/51
(58) Field of Search ..... 62/175, 157, 158, 62/231; 236/51; 165/205, 208, 209

(56) References Cited

U.S. PATENT DOCUMENTS 5,853,123 A * 12/1998 Okano et al. ..... 62/175 X
6,145,751 A * 11/2000 Ahmed ..... 236/51

* cited by examiner

*Primary Examiner*—Harry B. Tanner
(74) *Attorney, Agent, or Firm*—Birch, Stewart, Kolasch & Birch, LLP

(57) ABSTRACT

Air conditioner for multiple rooms of a building having a network provided thereto including an outdoor unit, an outdoor unit controller for controlling operation of the outdoor unit, more than one indoor units, an indoor unit controller for controlling operation of the indoor units, and a main controller connected to the outdoor controller and the indoor controller through the network for receiving information on operation states and operation conditions of the outdoor unit and the indoor units, and controlling the outdoor unit controller and the indoor unit controller according to the information and a preset system algorithm, thereby permitting an easy installation of the air conditioner, and to save an installation cost, and an efficient and optimal air conditioning operation.

3 Claims, 4 Drawing Sheets

AIR CONDITIONER FOR MULTIPLE ROOM

BACKGROUND OF THE INVENTION

1. Field of the Invention

The present invention relates to an air conditioner, and more particularly, an air conditioner for multiple rooms.

The air conditioner cools or heats a room(s) by discharging cooled air or heated air into the room to be consistent to preset volume of air and direction set by a user, for maintaining a room temperature to a level the user desires. In the air conditioner, there are a cooler operative in cooling cycle in an order of evaporation →compression →condensation →expansion, a heater operative in a heating cycle of a heat pump in which a four way valve is changed over at the expansion step, to reverse the cooling cycle, and a cooler/heater operative in the cooling cycle in summer, and in the heating cycle in winter. And, depending on a number of indoor units, there are a general air conditioner provided with one outdoor unit and one indoor unit, and an air conditioner for multiple rooms provided with one outdoor unit and multiple indoor units.

2. Background of the Related Art

Referring to FIG. 1, a related art air conditioner for multiple rooms is provided with an outdoor unit 1 for conduction of a cooling cycle, multiple indoor units 2 each for conducting air conditioning of a room by using refrigerant cooled in the outdoor unit 1, a pipeline 3 for circulation of the refrigerant through the outdoor unit 1 and the indoor units 2, solenoid valves for controlling refrigerant supply to respective indoor units 2, and exclusive lines 6 for transmission /reception of control signals and information on various system states between the outdoor unit 1 and the indoor units 2. The outdoor unit 1 has a compressor 11, a solenoid valve 14, a fan 12 and a condenser 13, and each of the indoor units 2 has a temperature sensor 22 for detecting a room temperature. In the related art air conditioner for multiple rooms, when a user provides an air conditioner order in the room the indoor unit 2 is provided thereto, the outdoor unit 1 cools down the refrigerant to an appropriate level according to an air conditioning cycle and supplies the refrigerant through the pipeline 3, and the controller of the indoor unit 2 controls the solenoid valve 23 according to an output of the temperature sensor 22, to conduct an air conditioning operation to a level the user desires. As transmission/reception of the various control signals for conducting the air conditioning operation and the system state information and the like are made through the exclusive line 6, a process for connecting the outdoor unit to respective indoor units through the exclusive line 6 is one of core processes in the installation of the air conditioner, which is restricted by exclusive line laying and related processes depending on a structure of the building and an installation method.

The related art air conditioner has the following problems.

First, the process for laying exclusive line between the indoor units and the outdoor unit is difficult and takes time as the process is influenced much by a structure of the building and the installation method.

Second, much cost is required if a distance between the indoor unit and the outdoor unit or between the indoor units is great.

SUMMARY OF THE INVENTION

Accordingly, the present invention is directed to an air conditioner for multiple rooms that substantially obviates one or more of the problems due to limitations and disadvantages of the related art.

An object of the present invention is to provide an air conditioner for multiple rooms which permits simple and low cost installation by using a network provided already in the building without separate exclusive line.

Another object of the present invention is to provide an air conditioner for multiple rooms, in which information on air conditioning is received through a network and a server connected thereto for making an optimal air conditioning operation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the air conditioner for multiple rooms of a building having a network provided thereto including an outdoor unit, an outdoor unit controller for controlling operation of the outdoor unit, more than one indoor units, an indoor unit controller for controlling operation of the indoor units, and a main controller connected to the outdoor controller and the indoor controller through the network for receiving information on operation states and operation conditions of the outdoor unit and the indoor units, and controlling the outdoor unit controller and the indoor unit controller according to the information and a preset system algorithm.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
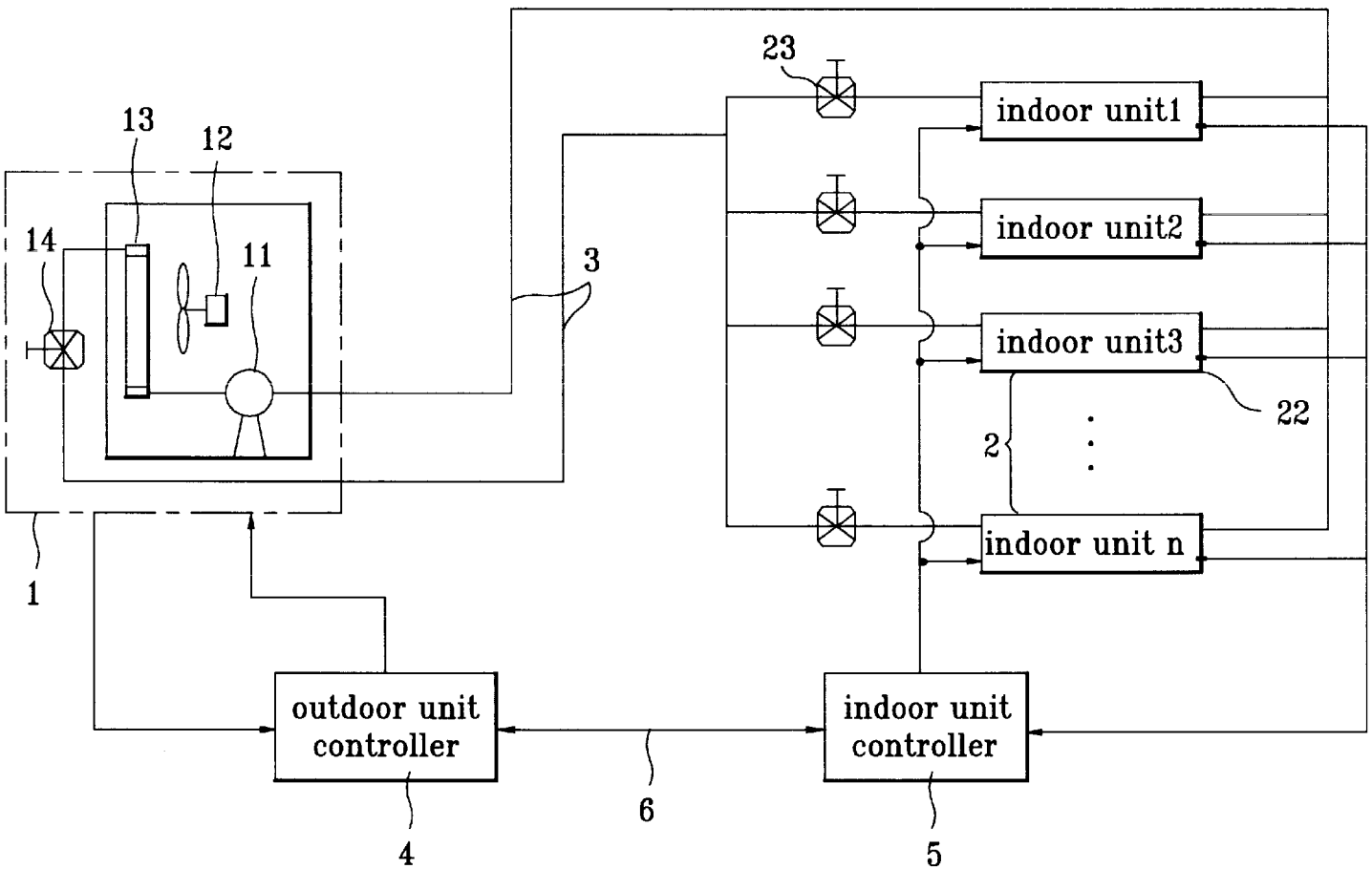
FIG. 1 illustrates a block diagram showing a system of a related art air conditioner for multiple rooms.
Figure 2:
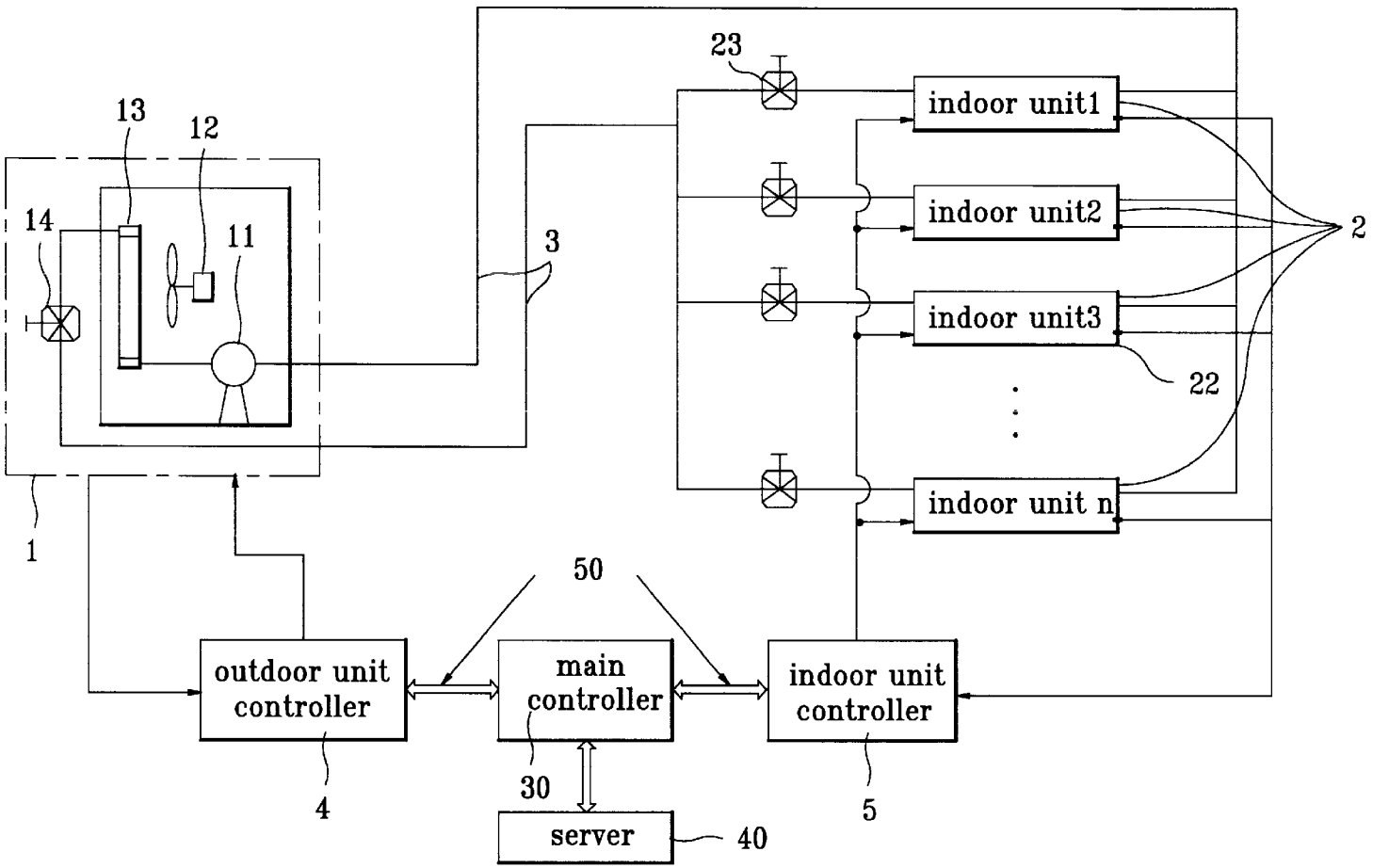
FIG. 2 illustrates a block diagram showing a system of an air conditioner for multiple rooms in accordance with a preferred embodiment of the present invention.

Referring to FIG. 2, the air conditioner for multiple rooms in accordance with a preferred embodiment of the present invention includes an outdoor unit 1, indoor units 2, a pipeline 3 for refrigerant circulation between the outdoor unit 1 and the indoor units 2, solenoid valves 23 for controlling refrigerant supply to respective indoor units 2, a server 40 for collecting various information on air conditioning, a main controller 30 for controlling an outdoor unit controller 4 and an indoor unit controller 5 by using information from the server 40, the outdoor unit controller 4 and the indoor unit controller 5, and a building network communication line 50 for exchange of information among the outdoor unit controller 4, the indoor unit controller 5, the server 40, and the main controller 30.

Figure 3:
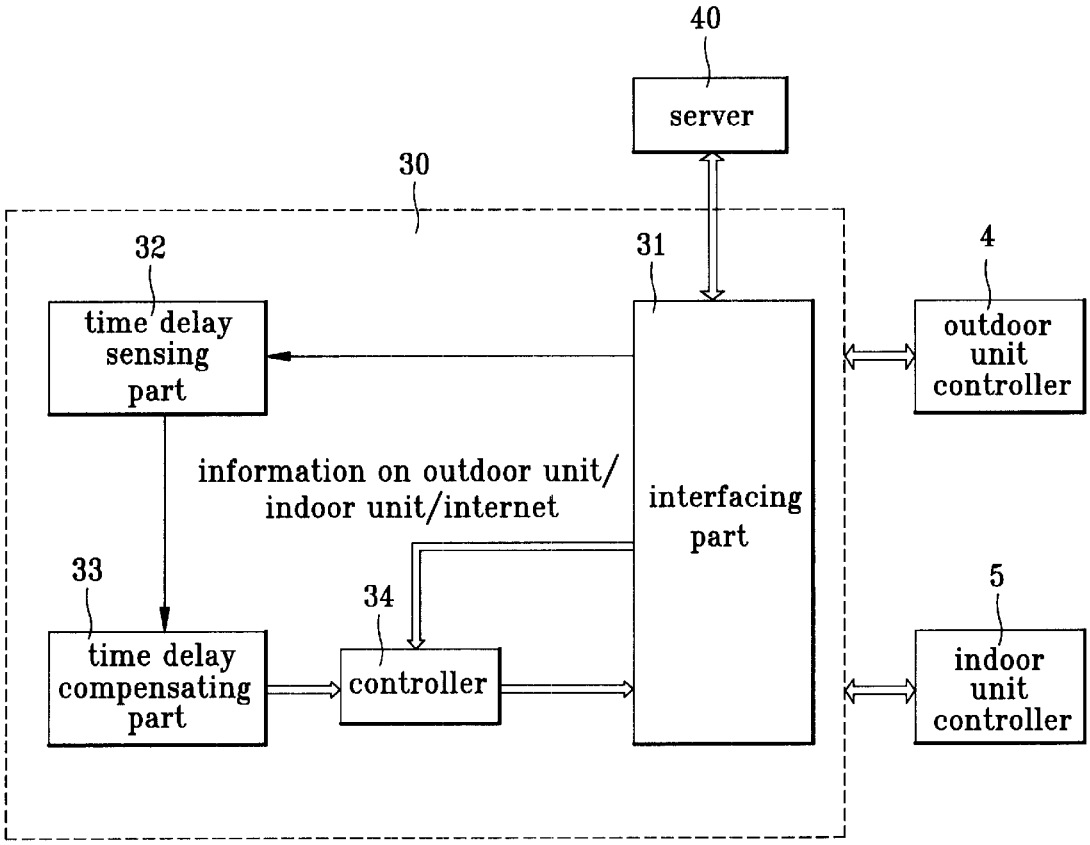
FIG. 3 illustrates a block diagram showing a detail of the main controller in FIG. 2; and, FIG. 4 illustrates a flow chart for showing a method for compensating a network time delay in the air conditioner for multiple rooms in accordance with the present invention.

Referring to FIG. 3, the main controller 30 includes an interfacing part 31 for data exchange between the outdoor unit controller 4, the indoor unit controller 5, and the server 40, a time delay sensing part 32 for sensing a delay of an information processing time through the interfacing part 31, a time delay compensating part 33 for compensating the delay of time obtained as a result of sensing at the time delay sensing part 32, and a controller 34 for controlling an entire air conditioning operation according to information received through the interfacing part 31 and an output of the time delay compensating part 33.

The operation of the air conditioner for multiple rooms in accordance with a preferred embodiment of the present invention will be explained.

The operation of the basic indoor units 2 and the solenoid valves 23 is controlled by the indoor unit controller 5, and the operation of the outdoor unit 1 and the solenoid valve 14 is controlled by the outdoor unit controller 4. If a user in a space one of the indoor units are provided thereto applies an air conditioning order, such as starting or temperature controlling, the air conditioning order from the user is transmitted to the main controller 30 through the communication line 50. And, information on operation states of respective indoor units 2 and room temperatures detected by the temperature sensors 22 is transmitted to the main controller 30. Then, the main controller 30 transmits an operation order to the outdoor unit 4 with reference to the information from the indoor controller 5 so that the air conditioning order the user provided is carried out. According to this, the outdoor unit 1, the indoor unit 2 and the solenoid valves 14 and 23 are put into operation under the control of the outdoor unit controller 4 and the indoor unit controller 5.

Figure 4:
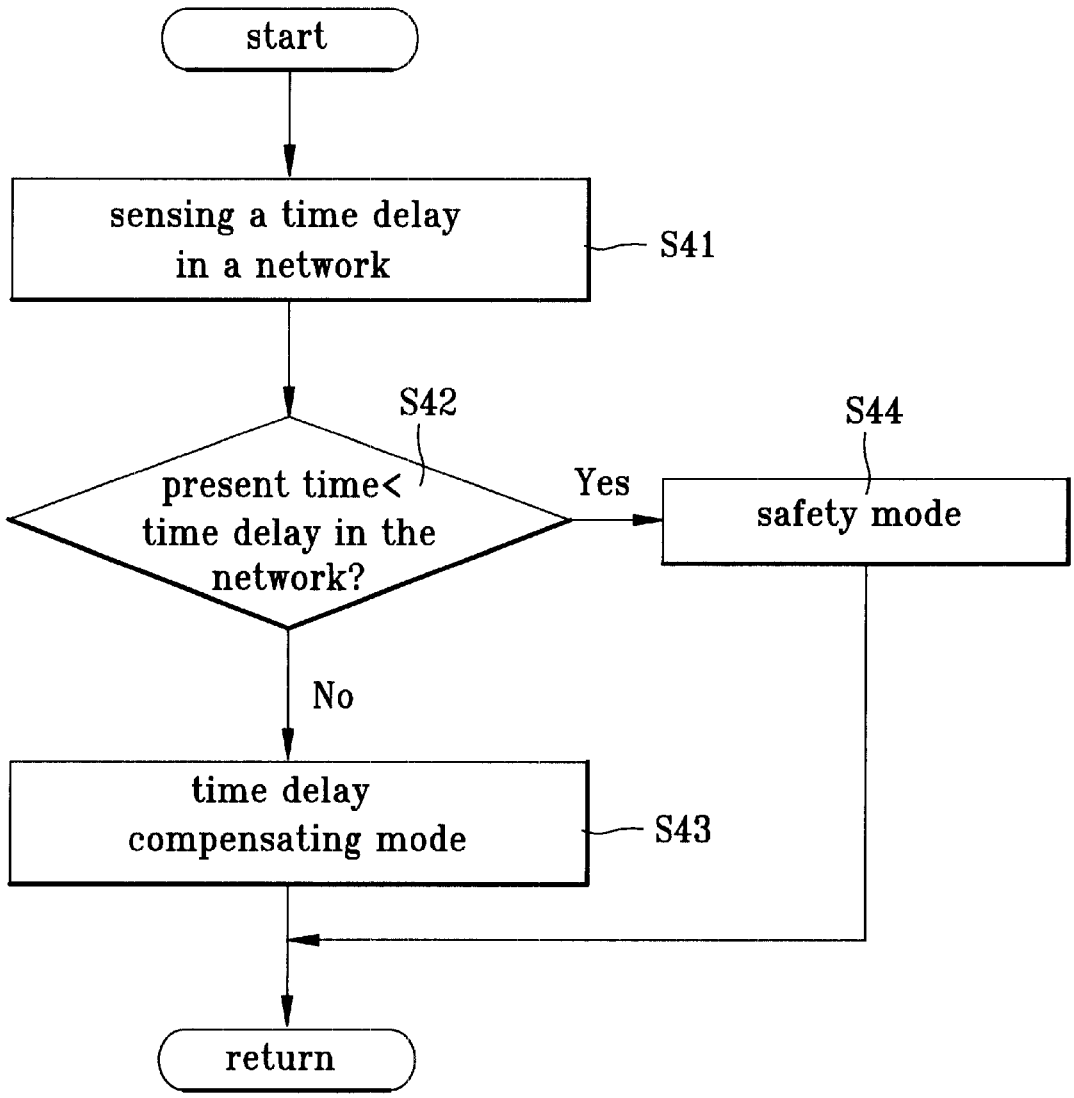

In this instance, different from the exclusive line, there may be delay in communication or protocol, which may cause troubles in the air conditioning operation when the delay is greater than a certain level. Accordingly, the present invention employs a method for compensating the possible time delay in the communication, which will be explained with reference to FIG. 4.

The method for compensating a time delay in a communication starts with sensing a time delay in the network at the time delay sensing part 32 in the main controller 30, and transmitting a result of the sensing to the time delay compensating part 33(S41). Then, the present network delay time is determined of having passed a preset time(S42), and, if not as a result of the determination(S42), a time delay compensating mode is conducted, to compensate for the time delay, and the air conditioner operation is conducted with reference to the compensated time (S43). That is, the time delay compensating part 33 receives a time delay value from the time delay sensing part 32, and calculates and transmits a compensating value to the controller 34 for preventing a regular operation of the controller from being impeded by the network time delay. Accordingly, the controller 34 controls the outdoor controller 4 and the indoor controller 5, to make a regular air conditioning operation. For example, once there is a time delay occurred in the network, the controller 34 provides control signals delayed compared to regular control signals to the outdoor controller 4 and the indoor controller 5, and, consequently, the outdoor controller 4 and the indoor controller 5 will also delay system control timings for compressors and the like, resulting to possible deterioration of the cooling performance. Therefore, the time delay compensating part 33 provides a compensating value required for controlling the system at an exact timing to the controller 34 taking the network time delay into account, so that the controller 34 makes regular control of the outdoor controller 4 and the indoor controller 5 according to the compensating value, for making a regular air conditioning operation. In the meantime, as a result of the determination(S42), if the network delay time passes the preset time, determining that the regular air conditioning operation can not be made even if a time delay compensating operation is conducted, the main controller 30 operates the air conditioner in a safety mode(S44). For example, when a user's operation order is reached to the main controller 30, with a delay to pass the preset time period owing to the network time delay, the controller operates the air conditioner in the safety mode, taking a safety of operation of the air conditioner into account to the maximum, since execution of the delayed user's order may result in a trouble in the air conditioner even though the air conditioner is overheated.

Moreover, the air conditioner for multiple rooms of the present invention is operative in more efficient and optimal air conditioning condition owing to the server 40 connected through a network. That is, the server 40 is connected to the internet, and collects various information on air conditioning, such as weather, and the like, so that the main controller 30 can make an appropriate control of the outdoor unit 4 and the indoor unit 5 based on the information on the air conditioning and the user's operation order, for providing an automatic, and optimal air conditioning.

As has been explained, the air conditioner for multiple rooms of the present invention has the following advantages.

First, the use of a network provided in a building without providing exclusive lines in an installation of the air conditioner permits an easy installation of the air conditioner, and to save an installation cost.

Second, the use of various information on air conditioning, such as outdoor temperature, received through the internet permits an efficient and optimal air conditioning operation.

It will be apparent to those skilled in the art that various modifications and variations can be made in the air conditioner for multiple rooms of the present invention without departing from the spirit or scope of the invention. Thus, it is intended that the present invention cover the modifications and variations of this invention provided they come within the scope of the appended claims and their equivalents.

What is claimed is:

1. An air conditioner for multiple rooms of a building having a network provided thereto comprising:

an outdoor unit;

an outdoor unit controller for controlling operation of the outdoor unit;

more than one indoor units;

an indoor unit controller for controlling operation of the indoor units; and, a main controller connected to the outdoor controller and the indoor controller through the network for receiving information on operation states and operation conditions of the outdoor unit and the indoor units, and controlling the outdoor unit controller and the indoor unit controller according to the information and the preset system algorithm, wherein the main controller includes:

an interfacing part for data exchange through the network;

a time delay sensing part for sensing a time delay in the network;

a time delay compensating part for compensating for the time delay from the time delay sensing part; and a controller for controlling air conditioning operation according to the data received through the interfacing part and an output of the time delay compensating part.

2. An air conditioner as claimed in claim 1, further comprising a server for collecting information on air conditioner operation from the internet through the network, and providing to the main controller.

3. An air conditioner for multiple rooms of a building having a network provided thereto comprising:

an outdoor unit;

an outdoor unit controller for controlling operation of the outdoor unit;

more than one indoor units;

an indoor unit controller for controlling operation of the indoor units; and, a main controller connected to the outdoor controller and the indoor controller through the network for receiving information on operation states and operation conditions of the outdoor unit and the indoor units, and controlling the outdoor unit controller and the indoor unit controller according to the information and the preset system algorithm, wherein the main controller controls the air conditioner such that an air conditioning operation delay is compensated as much as the time delay if the time delay in the network is within a preset time, and the air conditioner is operated in a safety mode if the time delay in the network is greater than the preset time period, for preventing trouble in the air conditioning operation.

* * * * *